US007418219B2

(12) United States Patent
Woo et al.

(10) Patent No.: US 7,418,219 B2
(45) Date of Patent: Aug. 26, 2008

(54) IMAGE FORMING APPARATUS INCLUDING SUPPORT MEMBER TO MAINTAIN INTERVAL BETWEEN EJECT TRAY AND IMAGE READING DEVICE

(75) Inventors: Ji-hoon Woo, Suwon-si (KR); In-sick Seo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 136 days.

(21) Appl. No.: 11/438,271

(22) Filed: May 23, 2006

(65) Prior Publication Data

US 2006/0291896 A1 Dec. 28, 2006

(30) Foreign Application Priority Data

Jun. 27, 2005 (KR) ..... 10-2005-0055552

(51) Int. Cl.
*G03G 15/00* (2006.01)

(52) U.S. Cl. ..... 399/107; 399/124; 399/405

(58) Field of Classification Search ..... 399/107, 399/405, 110, 124
See application file for complete search history.

(56) References Cited

U.S. PATENT DOCUMENTS 5,920,758 A * 7/1999 Ohtsuki ..... 399/405
6,728,511 B2 * 4/2004 Watanabe ..... 399/405
2001/0010770 A1 * 8/2001 Kominato ..... 399/405
2003/0198493 A1 10/2003 Gomi et al. ..... 399/380
2005/0135855 A1 * 6/2005 Park et al. ..... 399/405
2005/0286929 A1 * 12/2005 Park ..... 399/124
2006/0280521 A1 * 12/2006 Kang ..... 399/124

FOREIGN PATENT DOCUMENTS

EP 1 059 801 12/2000
JP 2000-295411 10/2000
JP 2004-177836 A * 6/2004
KR 2004-33810 4/2004

* cited by examiner

*Primary Examiner*—Sophia S Chen
(74) *Attorney, Agent, or Firm*—Stein, McEwen & Bui, LLP

(57) ABSTRACT

An image forming apparatus includes: an image recording device having an eject tray on a top thereof, and recording an image on a recording medium corresponding to input image data and discharging the recording medium onto the eject tray; an image reading device mounted over the image recording device to read the image, thereby converting the image to image data, and output the image data to the image recording device; at least one support member supporting the image reading device to keep a predetermined interval between the eject tray and the image reading device; and a pivot unit to pivotally support one end of the support member.

17 Claims, 8 Drawing Sheets

IMAGE FORMING APPARATUS INCLUDING SUPPORT MEMBER TO MAINTAIN INTERVAL BETWEEN EJECT TRAY AND IMAGE READING DEVICE

CROSS-REFERENCE TO RELATED APPLICATIONS

This application claims benefit under 35 U.S.C. § 119(a) of Korean Patent Application No. 2005-55552, filed Jun. 27, 2005, in the Korean Intellectual Property Office, the disclosure of which is incorporated herein by reference.

BACKGROUND OF THE INVENTION

1. Field of the Invention

Aspects of the invention relate to an image forming apparatus and, more particularly, relate to an image forming apparatus including a printer which forms an image corresponding to input image data on a recording medium and discharges the recording medium bearing the image to an eject tray mounted at an upper part thereof, and a scanner which reads out the image above the eject tray.

2. Description of the Related Art

Japanese Patent Publication No. 2000-295411 discloses an image forming apparatus that includes an image recording device having an eject tray on an upper surface and an image scanner mounted above the eject tray. FIG. 1 shows the structure of the image forming apparatus disclosed in the Japanese Patent Publication No. 2000-295411.

Referring to FIG. 1, the image forming apparatus includes a printer U2 formed with an eject tray TRh on the upper surface, an image scanner U3 having an operation panel PA provided at the upper part of a front surface, while being protruded forward, and a lower protruding part 16 provided at the longitudinal central part and rear part of a lower surface, while being protruded downward, a front part 17 of the lower surface, and a rack U1 connecting the printer U2 to the lower part and having a top plate U1*a* for supporting the image scanner U3 above the eject tray TRh on the upper surface of the printer U2.

In the above-structured conventional image forming apparatus, since a gap between the eject tray TRh and the image scanner U3 is open forward and transversely, the recording medium (not shown) discharged onto the eject tray can easily be taken out. However, the rack U1 formed as a cantilever, including the top plate U1*a*, is not stable enough to support the image scanner U3 so as not to droop. Factors that can cause the image scanner U3 to droop can include the weight of an automatic document feeder (ADF) which is mounted on the image scanner U3, the weight of document being scanned, and the weight of the image scanner U3, as well as a sudden impact by a user.

FIG. 2 shows the structure of another conventional image forming apparatus that includes a dedicated support member in relation to the above problem of droop in the image forming apparatus. Referring to FIG. 2, the image forming apparatus includes an image reading device 50S and an image recording device 50P. The image reading device 50S reads out image information from a document, whereas the image recording device 50P produces an image on a recording medium (not shown) according to the image information read by the image reading device 50S, by an electro-photographic system.

The image recording device 50P is equipped with an eject tray 51 onto which the recording medium bearing the image is discharged. The image reading device 50S is disposed apart from the eject tray 51 by a predetermined interval so as to provide a space for removing the recording medium. A dedicated support member 55 is further provided, herein, to prevent the image reading device 50S from being drooped by the weight of an ADF 53 which is mounted at one side of the image reading device 50S. However, the support member 55 can interfere in removing the recording medium from the eject tray 51.

SUMMARY OF THE INVENTION

An aspect, among other aspects, of the invention is to promote resolving at least the above problems and/or disadvantages in relation to droop in the image forming apparatus. Accordingly, an aspect of the invention is to provide an image forming apparatus that is capable of stably supporting an image scanner and that also facilitates an operation of removing a recording medium from an eject tray.

In order to achieve the above-described and/or other aspects of the invention, there is provided an image forming apparatus including: an image recording device to record an image on a recording medium corresponding to input image data and to discharge the recording medium onto an eject tray on a top of the image recording device; an image reading device mounted over the image recording device to read the image, to thereby convert the image to image data, and to output the image data to the image recording device; at least one support member to support the image reading device to maintain a predetermined interval between the eject tray and the image reading device; and a pivot unit to pivotally support one end of the support member. The pivot unit includes a pivot shaft to rotationally or pivotally connect the support member onto a lower part of the image reading device.

The image forming apparatus further includes a horizontality maintaining unit to fix a position of the support member as pivoted to a horizontal state or position. The horizontality maintaining unit includes a fastening recess member formed at a lower part of the image reading device and a fastening projection formed on a side of the support member to selectively engage with the fastening recess member. The fastening recess member has an opening directed in a downward direction from the lower part of the image forming device, and the fastening projection has a substantially spherical shape. Alternatively, the horizontality maintaining unit can include a magnetic member formed at the lower surface of the image reading device; and a metal member formed at the side of the support member.

The image forming apparatus further includes a verticality maintaining unit to fix a position of the support member as pivoted to a vertical state or position. The verticality maintaining unit includes: a receiving recess formed on a top surface of the image recording device; and a guide slide extended from the receiving recess to smoothly guide pivoting of the support member.

In embodiments of an image forming apparatus of the invention, by providing the supporting member to support the image reading device, such as according to the above described and/or other aspects of the invention, the image reading device can be stabilized and a removal of the recording medium with relative ease is promoted.

Additional aspects and/or advantages of the invention are set forth in the description which follows or are evident from the description, or can be learned by the practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
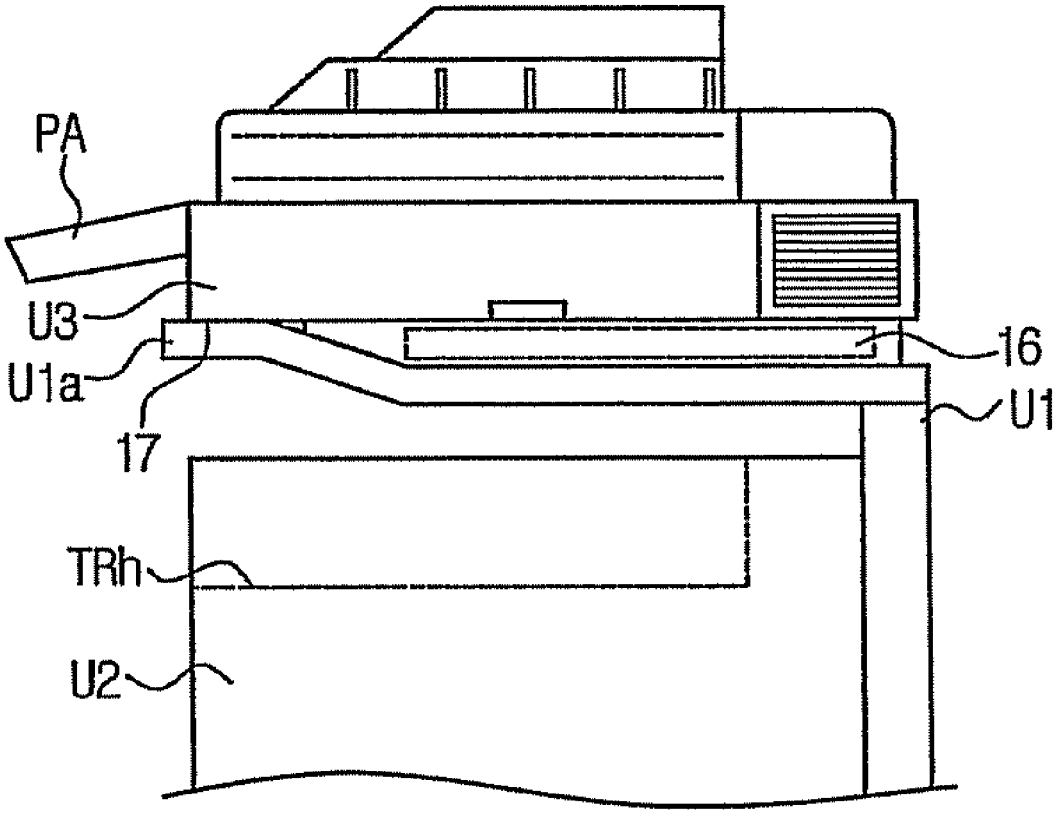
FIG. 1 (RELATED ART)
FIG. 1 shows an example of a conventional image forming apparatus, as disclosed in Japanese Patent Publication No. 2000-295411.
Figure 2:
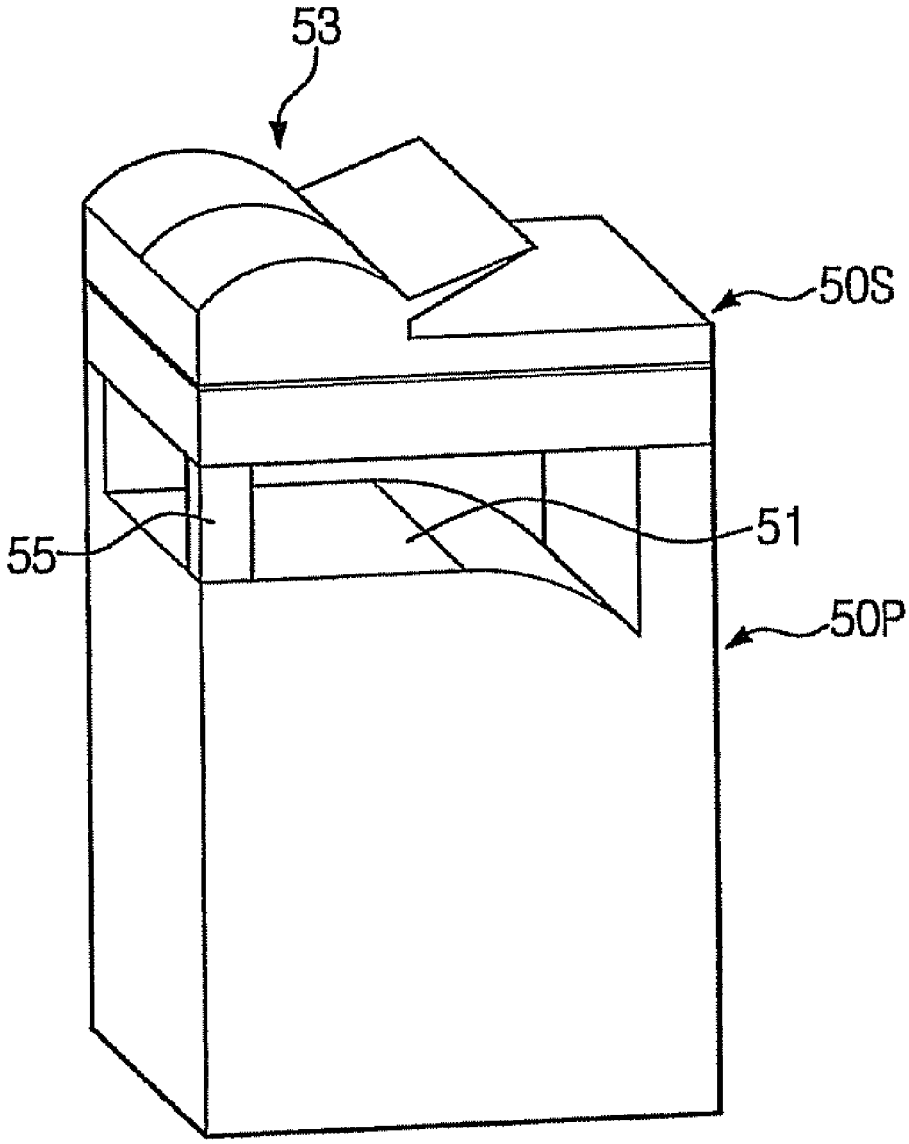
FIG. 2 (RELATED ART)
FIG. 2 schematically shows the structure of another conventional image forming apparatus.

Reference will now be made in detail to embodiments of the invention, examples of which are illustrated in the accompanying drawings, wherein like reference numerals refer to the like elements throughout. The embodiments are described below in order to explain aspects of the invention by referring to the figures, with well-known functions or constructions not necessarily being described in detail.

Figure 3:
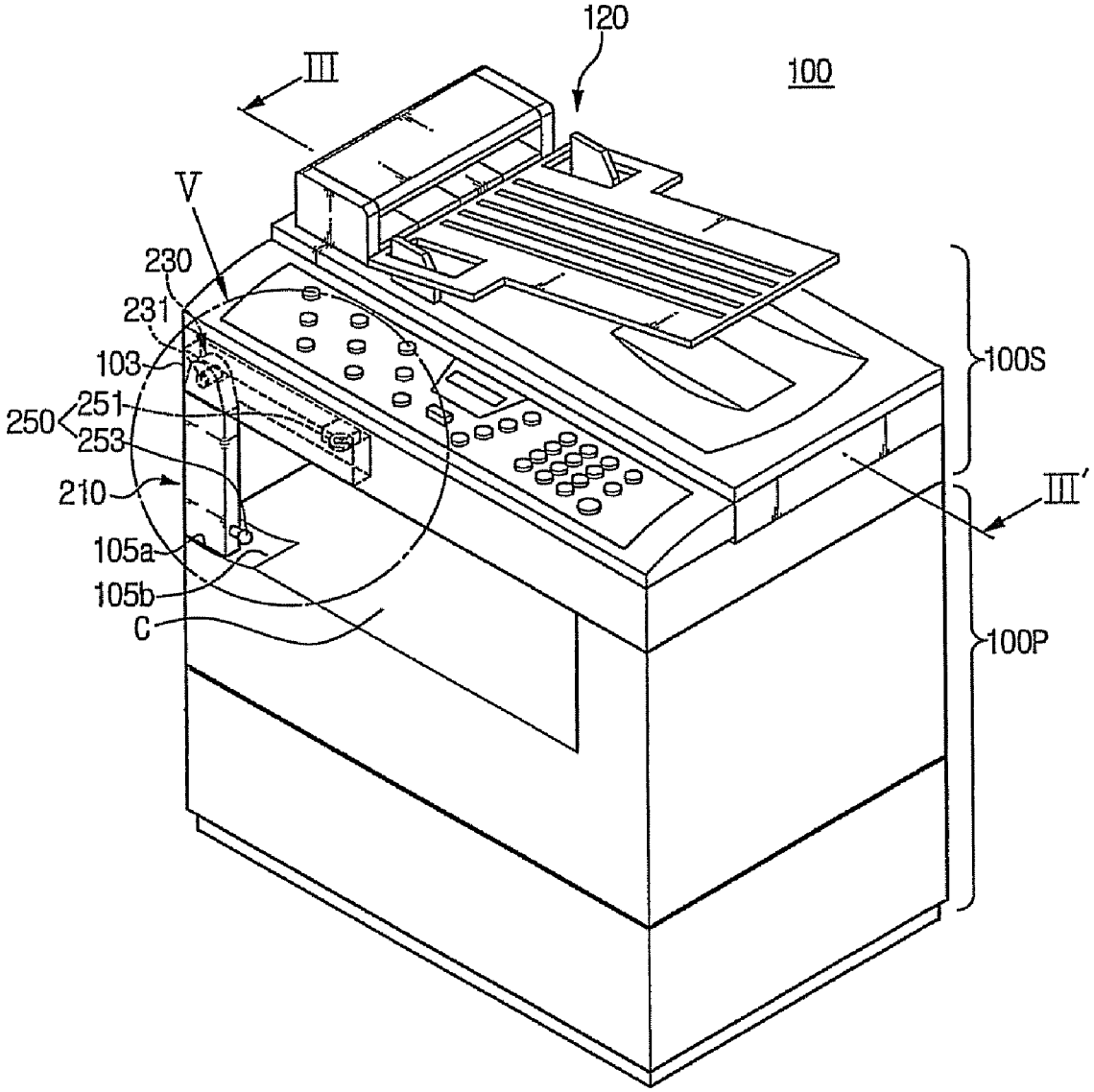
FIG. 3 (RELATED ART)
FIG. 3 is a perspective view showing an image forming apparatus according to an embodiment of the invention.

FIG. 3 is a perspective view of an image forming apparatus according to an embodiment of the invention. Referring to FIG. 3, an image forming apparatus 100 includes an image reading device 100S which reads out image information from a document, an image recording device 100P which produces an image on a recording medium based on the image information read by the image reading device 100S, by an electrophotographic system, and a support member 210 which supports the image reading device 100S.

Figure 4:
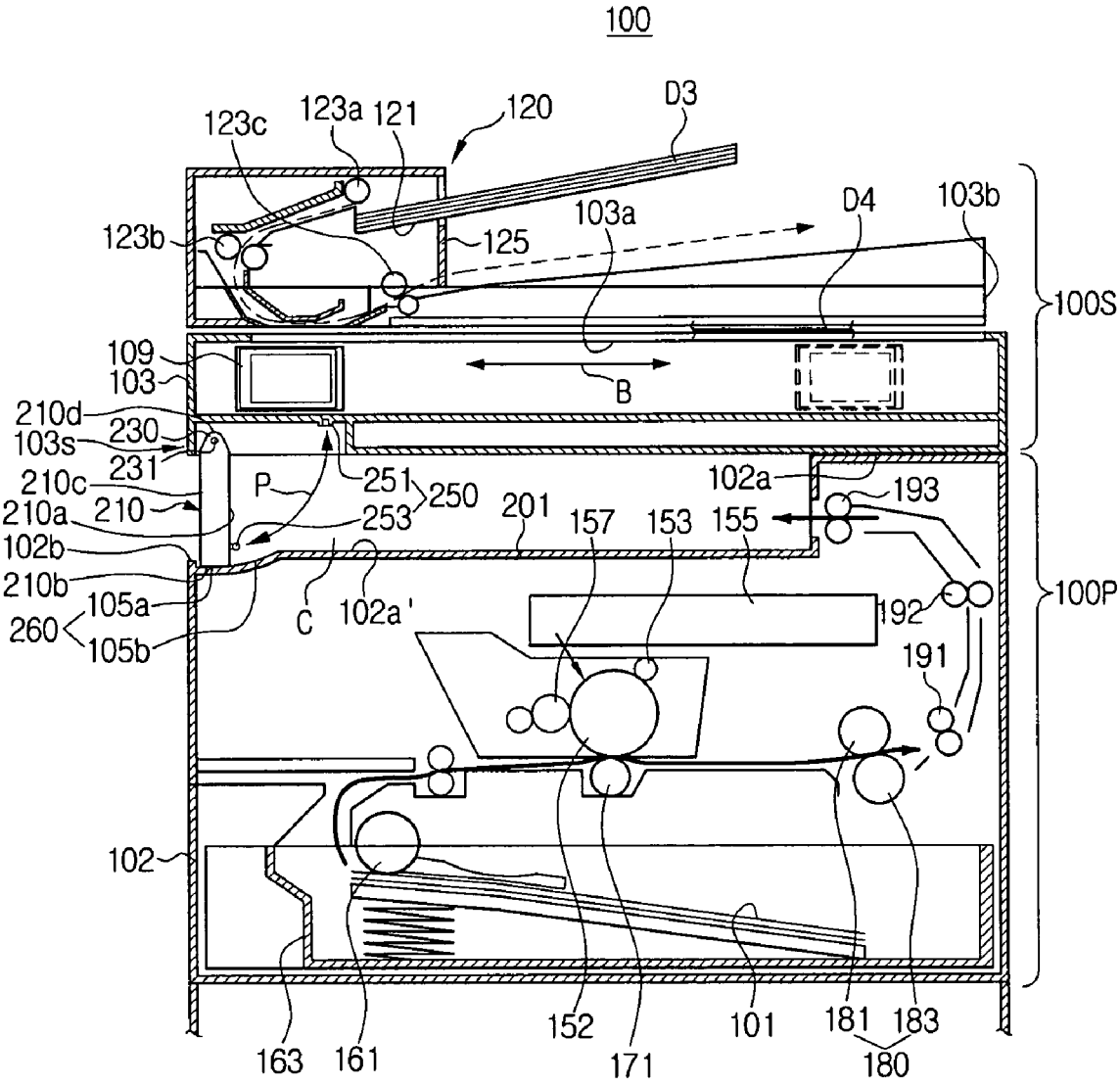
FIG. 4 is a sectional view of FIG. 3 taken along a line III-III', to explain the operation of an image forming apparatus according to an aspect of the invention.

FIG. 4 is a sectional view of FIG. 3, taken along the line III-III', to explain the operation of the image forming apparatus 100 according to an aspect of the invention. In the operation of the image reading device 100S, a multifunction apparatus having a scanning and/or copy function, such as a photocopier and a facsimile, is equipped with an automatic document feeder (ADF) 120. When copying a plurality of documents, the ADF 120 can save time in copying the documents by automatically feeding the documents to be copied without requiring replacement of the documents one by one, or opening and closing a scanner cover to copy each of the documents.

More specifically, a first document D3 supplied from a document tray 121 is picked up by a pickup roller 123*a*. The first document D3 picked up by the pickup roller 123*a* is conveyed by a conveying roller 123*b* to an image reading unit 109 mounted in an image reading main body 103 of the image reading device 100S. One side of the first document D3 is read out at the image reading unit 109 and discharged by a discharge roller 123*c* to the outside of a main body 125 of the ADF 120, thus completing the image reading process. Meanwhile, when image reading is performed by opening up a cover 103*b* and setting a second document D4 on a top of a platen glass 103*a*, the image reading unit 109 linearly reciprocates in directions shown by a bi-directional arrow B (FIG. 4).

The image recording device 100P produces an image on the recording medium 101 according to the image information read out by the image reading device 100S. In producing the image, a photoconductive drum 152 is rotated in a predetermined direction, thereby being electrically charged to a predetermined potential by a first electrifying roller 153. A predetermined light, such as a laser beam, is projected on a surface of the charged photoconductive drum 152 by a laser scanning unit 155. Accordingly, an electrostatic latent image is formed on the photoconductive drum 152. The electrostatic latent image formed on the photoconductive drum 152 is developed to a visible image by a developer supplied by a developing roller 157.

The recording medium 101 received in a paper feeding cassette 163 is picked up sheet by sheet and supplied to the photoconductive drum 152 by the feeding roller 161. The recording medium 101 is supplied to a transfer nip, which refers to a contacting area between the photoconductive drum 152 and the transfer roller 171, and the developer image (visible image) formed on the photoconductive drum 152 is transferred onto the recording medium 101. The developer image is fused on the recording medium 101 while the recording medium passes through a fixing unit 180 that includes a fixing roller 181 and a pressing roller 183. The recording medium 101 passed through the fixing unit 180 is discharged to an eject tray 201 by the discharging rollers 191 to 193.

Also, the recording medium 101 and documents, such as documents D3 and D4, in addition to being a paper type media, can also be other types of media, such as film type media, or other suitable type media for image forming, in practice and applications of the invention. As such, references herein to paper also can correspond to other suitable medium or media, and the references to image forming apparatus can also apply to corresponding image forming apparatus for other suitable media, according to aspects of the invention.

The image reading device 100S is disposed at a predetermined distance from the eject tray 201 so as to provide a space C, forming a predetermined spaced interval, for a user to remove the recording medium 101 discharged onto the eject tray 201. However, in view of presence of the ADF 120, the centroid of the image reading device 100S is not necessarily stably supported. In this regard, such as when scanning a heavy document, such as a document with a relatively large number of sheets, the image reading device 100S can droop. Consequently, exemplary structure, according to aspects of the invention, which promotes supporting stably the image reading device 100S, as well as maintaining the predetermined spaced interval formed by the space C between the image reading device 100S and the image recording device 100P, is provided and illustrated in the image forming apparatus 100 of FIGS. 3 to 6.

Figure 5A:
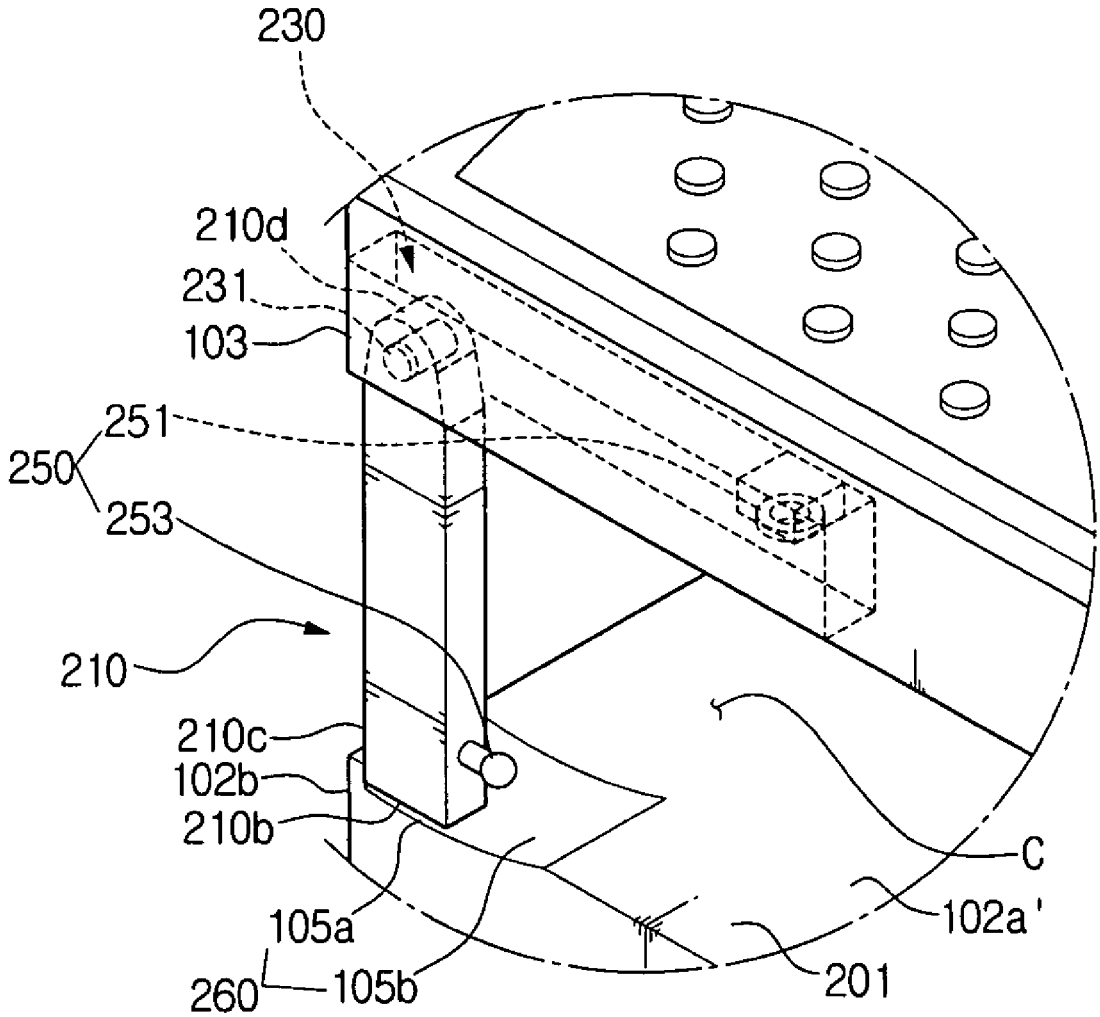
FIG. 5A shows an enlarged portion V of FIG. 3 of the structure of a support member of an image reading device, according to an embodiment of the invention.
Figure 5B:
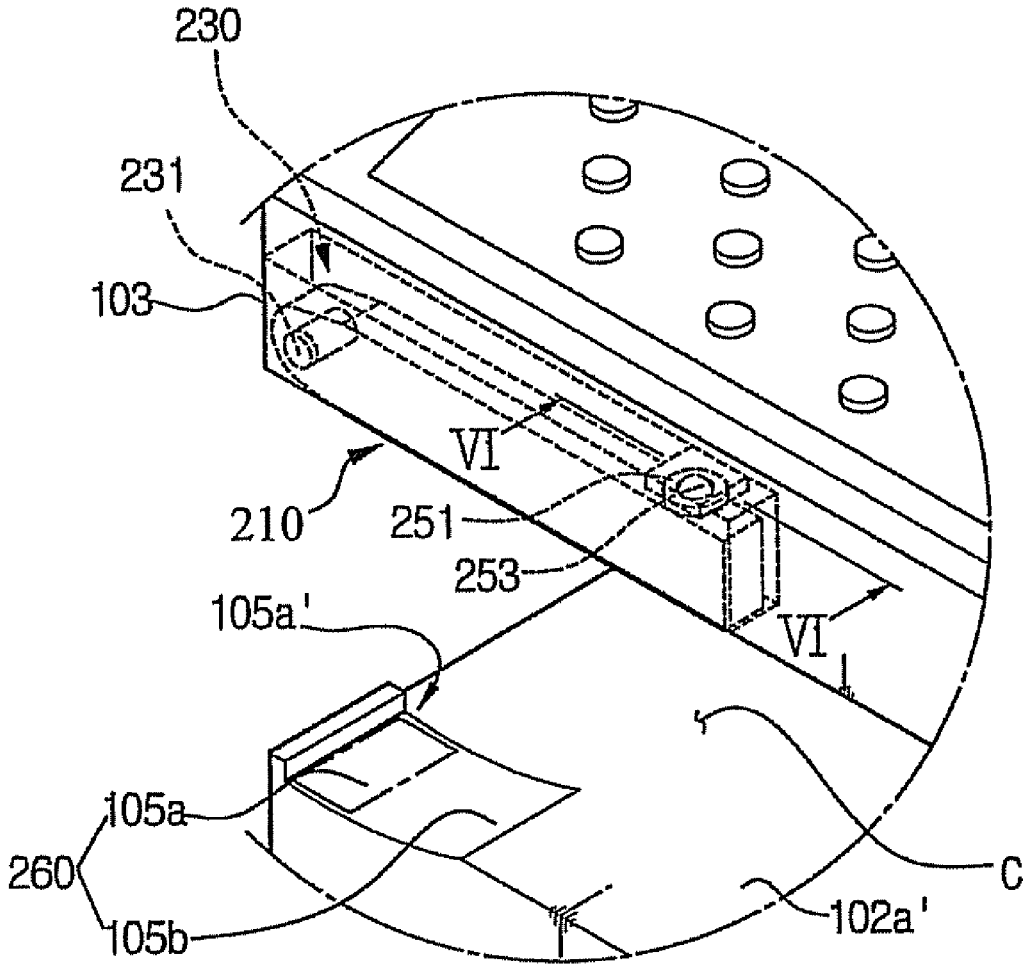
FIG. 5B shows the support member of FIG. 5A according to an embodiment of the invention, as pivoted to a horizontal position.
Figure 6:
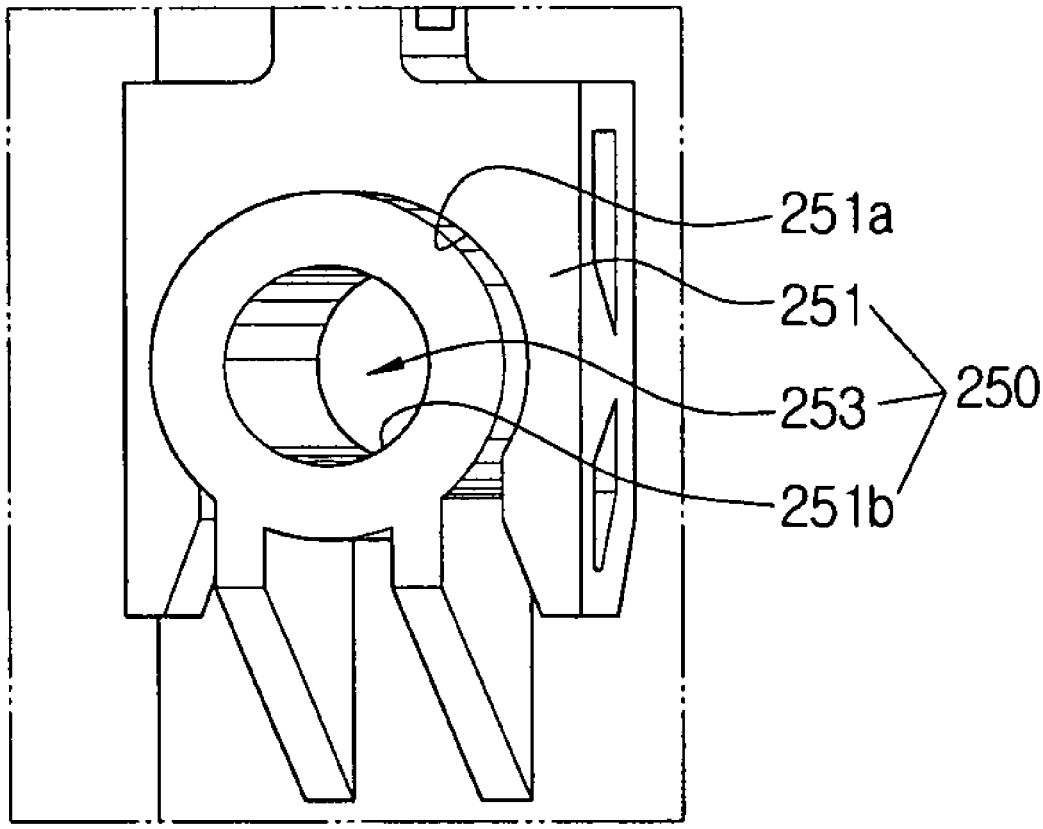
FIG. 6 is a sectional view of FIG. 5B taken along line VI-VI of FIG. 5B.

FIG. 5A shows an enlarged view of the portion V of FIG. 3 to illustrate the structure of a support member 210 to support the image reading device 100S, according to an embodiment of the invention. FIG. 5B shows the support member as pivoted to a horizontal position. FIG. 6 is a sectional view of FIG. 5B taken along the line VI-VI of FIG. 5B.

Referring to FIGS. 4 to 6, the image reading device 100S is connected with an upper surface 102*a* of an image recording main body 102 on one end while supported by the dedicated support member 210 on the other end. The support member 210 is configured to selectively pivot, so that the recording medium 101 stacked on the eject tray 201 can be removed from the eject tray 201 without interference by the support member 210. More specifically, when the user wants to remove the recording medium 101 from the eject tray 201, the support member 210 is pivoted in a direction into the image reading main body 103, or the image recording main body 102, such as indicated by the double headed arrow P, thereby thoroughly opening the space C where the recording medium or media 101 is/are stacked on the eject tray 201. In order to support the image reading device 100S, the support member 210 is pivoted back in the opposite direction, such as indicated by the double headed arrow P, to its initial position, such as in communication with an upper surface 102*a*' of the image recording main body 102, with the top surface 102*a*' typically being lower in relation to the top surface 102*a* of the image recording main body 102 to provide for the space for the recording medium or media 101. The support member 210, supporting the image reading device 100S, typically does not cause much trouble in withdrawing a relatively small size recording medium or media 101 from the space C. However, when the recording medium or media 101 is/are of a relatively large size, such as A3 paper, the support member 210 can possibly interfere with the withdrawing of the recording medium or media 101. The embodiment of the invention such as illustrated in FIGS. 4 to 6, according to aspects of the invention, promotes resolving possible interference with the withdrawing of the recording medium 101 by pivoting the support member 210 inward, as described.

Continuing with reference to FIGS. 4 to 6, the support member 210 pivots, or rotates, on a hinge unit 230, as a pivot unit, formed at an upper end, or upper side, 210*d* or lower end, or lower side, 210*b* of the support member 210. In the illustrations of FIGS. 4 to 6, the support member 210 has the hinge unit 230 at the upper end 210*d* so as to pivot at the lower part 103*s* of the image reading main body 103 of the image reading device 100S. The hinge unit 230 includes a pivot pin 231 to pivotally support the support member 210. In addition, according to an aspect of the invention, a horizontality maintaining unit 250 is provided to fix a position of the support member 210 in a generally horizontal state or position, such as illustrated in FIG. 5B, where the support member is pivoted, or rotated, to a state that the space C is opened.

Referring to FIGS. 4, 5A, 5B and 6, the horizontality maintaining unit 250 includes a fastening recess member 251 formed at the lower surface, or part, 103*s* of the image reading main body 103 and a fastening projection 253 formed at a flank, or side, 210*a* of the support member 210 to fit, or engage, with a fastening recess 251*a* of the fastening recess member 251 when the support member 210 is pivoted to a horizontal position. The fastening recess 251*a* includes an opening 251*b* opened downward from the lower part, or surface, 103*s* to receive, or engage, the fastening projection 253 when the support member is pivoted to the generally horizontal position. The fastening projection 253 typically has a substantially spherical, or other suitable, shape. A diameter of the fastening projection 253 is formed with a width, or diameter, slightly larger than the opening 251*b*, or of a dimension or size, so as to provide a force-fit, or generally snug, engagement between the fastening projection 253 and the opening 251*b*, with the fastening recess 251*a* being formed of a suitable material to permit the selective engagement and disengagement of the fastening projection 253 with the fastening recess 251*a*.

Referring to FIGS. 4, 5A and 5B, a verticality maintaining unit 260, according to an aspect of the invention, can be further provided to secure a vertical position of the support member 210. The verticality maintaining unit 260 includes a receiving recess 105*a* formed on the top surface 102*a*' of the image recording main body 102 to seat an end, or side, 210*b* of the support member 210, and a guide slide 105*b* extended from one side 105*a*' of the receiving recess 105*a* to facilitate pivoting of the support member 210 without interference by the image recording main body 102. Also, the image recording main body 102 can include an upwardly extending projection or stop 102*b* to engage with a side 210*c* of the support member 210 to assist in securing the support member 210 in a generally vertical position.

Figure 7:
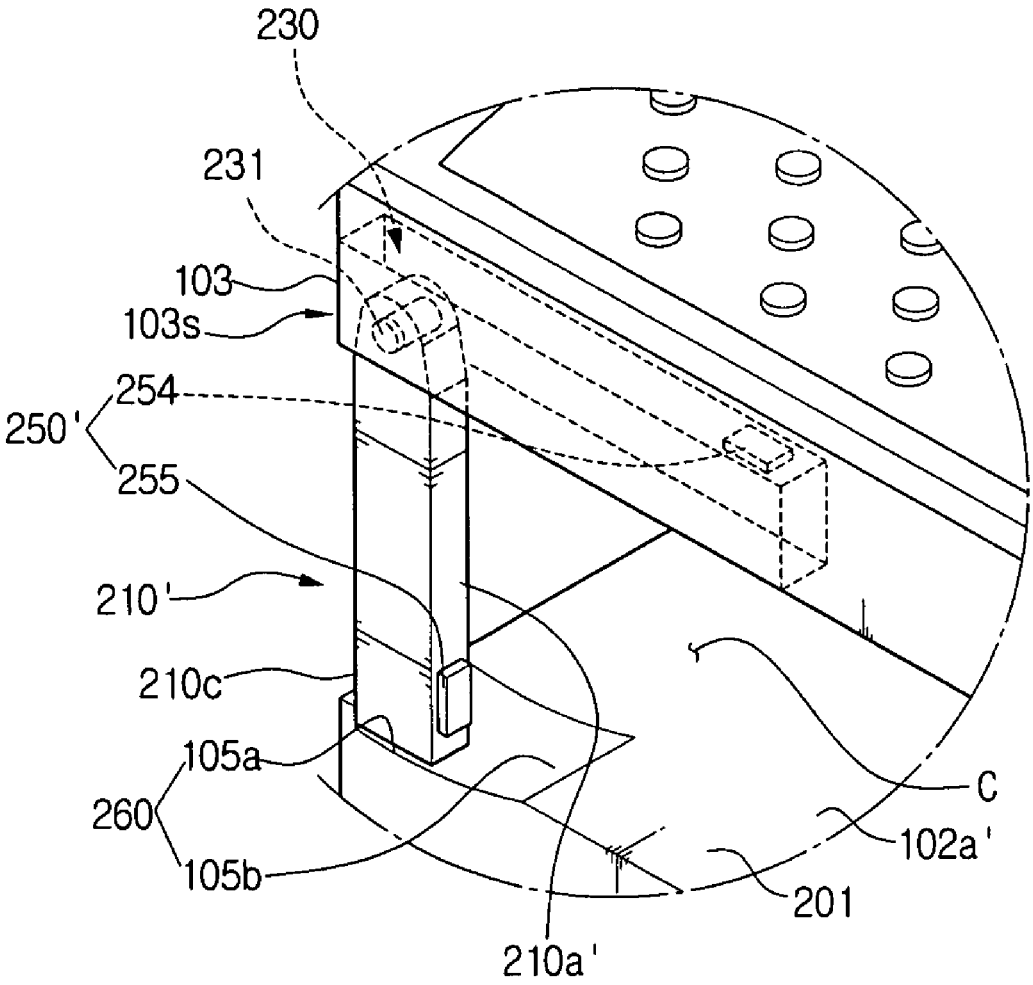
FIG. 7 shows a horizontality maintaining unit according to another embodiment of the invention.

FIG. 7 shows a horizontality maintaining unit 250' to selectively maintain a support member 210' where the support member 210' is pivoted to the generally horizontal position in the image forming apparatus 100 of FIGS. 3 and 4. Like the support member 210 of FIGS. 5A, 5B and 6, the support member 210' is configured to selectively pivot, so that the recording medium 101 stacked on the eject tray 201 can be removed from the eject tray 201 without interference by the support member 210. More specifically, when the user wants to remove the recording medium 101 from the eject tray 201, the support member 210' is pivoted in a direction into the image reading main body 103, or the image recording main body 102, such as indicated by the double headed arrow P in FIG. 4, thereby thoroughly opening the space C where the recording medium or media 101 are stacked on the eject tray 201.

However, in the horizontality maintaining unit 250', instead of the fastening recess member 251 and the fastening projection 253, as employed with the support member 210 in the embodiment of FIGS. 5A, 5B, and 6, the horizontality maintaining unit 250' fixes the horizontal position of the support member 210 using a magnetic force. That is, the horizontality maintaining unit 250' can include a magnetic member 254, such as a suitable magnet, attached on the lower part 103*s* of the image reading main body 103 and a magnetically attracted member 255, of a suitable metal or magnetic material or composition, that is selectively held by the magnetic force in engaging relation with the magnetic member 254, where the support member 210' is held in a generally horizontal position. The magnetically attracted member 255 is suitably fastened or attached to the flank, or side, 210*a*' of the support member 210' to be attracted by the magnetic member 254 to permit the selective engagement and disengagement of the magnetically attracted member 255 with the magnetic member 254. The support member 210' pivots counterclockwise in the embodiment of FIG. 7 to engage the magnetically attracted member 255 with the magnetic member 254. However, as described, the pivoting direction is not limited in this regard.

The foregoing embodiments, aspects and advantages are merely exemplary and are not to be construed as limiting the invention. Also, the description of the embodiments of the invention is intended to be illustrative, and not to limit the scope of the claims, and various other alternatives, modifications, and variations will be apparent to those skilled in the art. Therefore, although a few embodiments of the invention have been shown and described, it would be appreciated by those skilled in the art that changes may be made in the embodiments without departing from the principles and spirit of the invention, the scope of which is defined in the claims and their equivalents.

What is claimed is:

1. An image forming apparatus, comprising:

an image recording device to record an image on a recording medium corresponding to input image data and to discharge the recording medium onto an eject tray on a top of the image recording device;

an image reading device mounted over the image recording device to read the image, to thereby convert the image to image data, and to output the image data to the image recording device;

support member to support the image reading device, and to maintain a predetermined interval between the eject tray and the image reading device, and to open a portion of the predetermined interval, by moving into engagement with the image reading device; and a pivot unit to pivotally support one end of the supporting member.

2. The image forming apparatus of claim 1, wherein:

the pivot unit includes a pivot shaft to rotationally connect the support member onto a lower part of the image reading device.

3. An image forming apparatus, comprising:

an image recording device to record an image on a recording medium corresponding to input image data and to discharge the recording medium onto an eject tray on a top of the image recording device;

an image reading device mounted over the image recording device to read the image, to thereby convert the image to image data, and to output the image data to the image recording device;

support member to support the image reading device, and to maintain a predetermined interval between the eject tray and the image reading device;

a pivot unit to pivotally support one end of the support member, comprising a pivot shaft to rotationally connect the support member onto a lower part of the image reading device; and a horizontality maintaining unit to fix a position of the support member, where the support member is pivoted to a horizontal position.

4. The image forming apparatus of claim 3, wherein:

the horizontality maintaining unit includes:

a fastening recess member formed at a lower part of the image reading device, and a fastening projection formed on a side of the support member to engage with the fastening recess member.

5. The image forming apparatus of claim 4, wherein:

the fastening recess member has an opening directed in a downward direction from the lower part of the image reading device, and the fastening projection has a substantially spherical shape.

6. The image forming apparatus of claim 3, wherein:

the horizontality maintaining unit comprises:

a magnetic member formed at the lower part of the image reading device, and a metal member formed at a side of the support member.

7. An image forming apparatus, comprising:

an image recording device to record an image on a recording medium corresponding to input image data and to discharge the recording medium onto an eject tray on a top of the image recording device;

an image reading device mounted over the image recording device to read the image, to thereby convert the image to image data, and to output the image data to the image recording device;

support member to support the image reading device, and to maintain a predetermined interval between the eject tray and the image reading device;

a pivot unit to pivotally support one end of the support member, comprising a pivot shaft to rotationally connect the support member onto a lower part of the image reading device; and a verticality maintaining unit to fix a position of the support member, where the support member is pivoted to a vertical position.

8. The image forming apparatus of claim 7, wherein:

the verticality maintaining unit comprises:

a receiving recess formed on a top surface of the image recording device, and a guide slide extended from the receiving recess to guide pivoting of the support member.

9. The image forming apparatus of claim 8, wherein:

the image reading device comprises a multifunction apparatus to scan or copy the image.

10. The image forming apparatus of claim 9, wherein:

the image reading device further comprises an automatic document feeder.

11. The image forming apparatus of claim 8, wherein:

the image recording device includes an upwardly extending projection to engage with a side of the support member to secure the support member in a generally vertical position.

12. An image forming apparatus, comprising:

an image recording device to record an image on a recording medium;

an image reading device positioned over the image recording device to read the image; and support member to support and maintain the image reading device at a predetermined spaced interval between the image recording device and the image reading device, by moving into engagement with the image recording device, and to open a portion of the predetermined spaced interval, by moving into engagement with the image reading device.

13. The image forming apparatus of claim 12, further comprising:

a horizontality maintaining unit to fix a position of the support member, where the support member is pivoted to a horizontal position.

14. The image forming apparatus of claim 13, further comprising:

a verticality maintaining unit to fix a position of the support member, where the support member is pivoted to a vertical position.

15. An image forming apparatus, comprising:

an image recording device to record an image on a recording medium, and comprising an upwardly extending projection;

an image reading device positioned over the image recording device to read the image;

support member to support and maintain the image reading device at a predetermined spaced interval between the image recording device and the image reading device, with the support member selectively moving into and out of engagement with one of the image recording device and the image reading device;

a horizontality maintaining unit to fix a position of the support member, where the support member is pivoted to a horizontal position; and a verticality maintaining unit to fix a position of the support member, where the support member is pivoted to a vertical position, wherein the protection of the image recording device engages with the support member, to secure the support member in a generally vertical position.

16. An image forming apparatus, comprising:

an image recording device to record an image on a recording medium, comprising an upwardly extending projection;

an image reading device positioned over the image recording device to read the image;

support member to support and maintain the image reading device at a predetermined spaced interval between the image recording device and the image reading device, with the support member selectively moving into and out of engagement with one of the image recording device and the image reading device; and a horizontality maintaining unit to fix a position of the support member, when the support member is pivoted to a horizontal position, wherein the projection of the image recording device engages with the support member, to secure the support member in a generally vertical position.

17. A method of support in an image forming apparatus, comprising:

positioning an image reading device to read an image over an image recording device to record the image on a recording medium to form a predetermined spaced interval between the image reading device and the image recording device;

selectively supporting the image reading device with support member to maintain the predetermined spaced interval between the image recording device and the image reading device; and selectively opening a portion of the predetermined spaced interval, by selectively moving the support member into engagement with the image reading device.

* * * * *

UNITED STATES PATENT AND TRADEMARK OFFICE

CERTIFICATE OF CORRECTION

PATENT NO. : 7,418,219 B2
APPLICATION NO. : 11/438271
DATED : August 26,2008
INVENTOR(S) : Ji-hoon Woo et al.

It is certified that error appears in the above-identified patent and that said Letters Patent is hereby corrected as shown below:

Column 7, line 10, change “supporting” to --support--.

Signed and Sealed this

Twenty-first Day of October, 2008

JON W. DUDAS
*Director of the United States Patent and Trademark Office*